US010359245B2

(12) United States Patent
Abbott

(10) Patent No.: US 10,359,245 B2
(45) Date of Patent: Jul. 23, 2019

(54) ROTATABLE FIREARM ROTOR

(71) Applicant: Brian F. Abbott, Fort Worth, TX (US)

(72) Inventor: Brian F. Abbott, Fort Worth, TX (US)

( * ) Notice: Subject to any disclaimer, the term of this patent is extended or adjusted under 35 U.S.C. 154(b) by 419 days.

(21) Appl. No.: 15/000,339

(22) Filed: Jan. 19, 2016

(65) Prior Publication Data

US 2017/0205167 A1 Jul. 20, 2017

(51) Int. Cl.

| | |
|---|---|
| ***F41A 9/30*** | (2006.01) |
| ***F41A 9/36*** | (2006.01) |
| ***F41A 7/10*** | (2006.01) |
| ***F41F 1/10*** | (2006.01) |

(52) U.S. Cl.

CPC *F41A 9/30* (2013.01); *F41A 7/10* (2013.01); *F41A 9/36* (2013.01); *F41F 1/10* (2013.01)

(58) Field of Classification Search

CPC ..... F41A 9/36; F41A 9/30
USPC ..... 89/33.25, 12
See application file for complete search history.

(56) References Cited

U.S. PATENT DOCUMENTS

| | | | | |
|---|---|---|---|---|
| 4,658,701 A * | 4/1987 | Moore | ..... | F41A 9/31 89/33.2 |
| 6,443,044 B1 * | 9/2002 | Dillon | ..... | F41A 9/36 89/12 |
| 6,742,434 B1 | 6/2004 | Dillon | | |
| 7,930,964 B1 | 4/2011 | Dillon | | |

* cited by examiner

*Primary Examiner* — Reginald S Tillman, Jr.
(74) *Attorney, Agent, or Firm* — Geoffrey E. Dobbin; Dobbin IP Law P.C.

(57) ABSTRACT

A rotor for a firearm having a tracks and locks for interaction with at least one firearm bolt with a rotatable head and carrier body may have a reversible lock structure such that locks may be merely turned around in relation to the rotor when one set of lock bosses is worn by the interaction of the lock and bolts when firing. Drive and delinker gears may also be geometrically keyed to the rotor to efficiently divide torque across the gears and to maintain correct timing for the firearm.

4 Claims, 9 Drawing Sheets

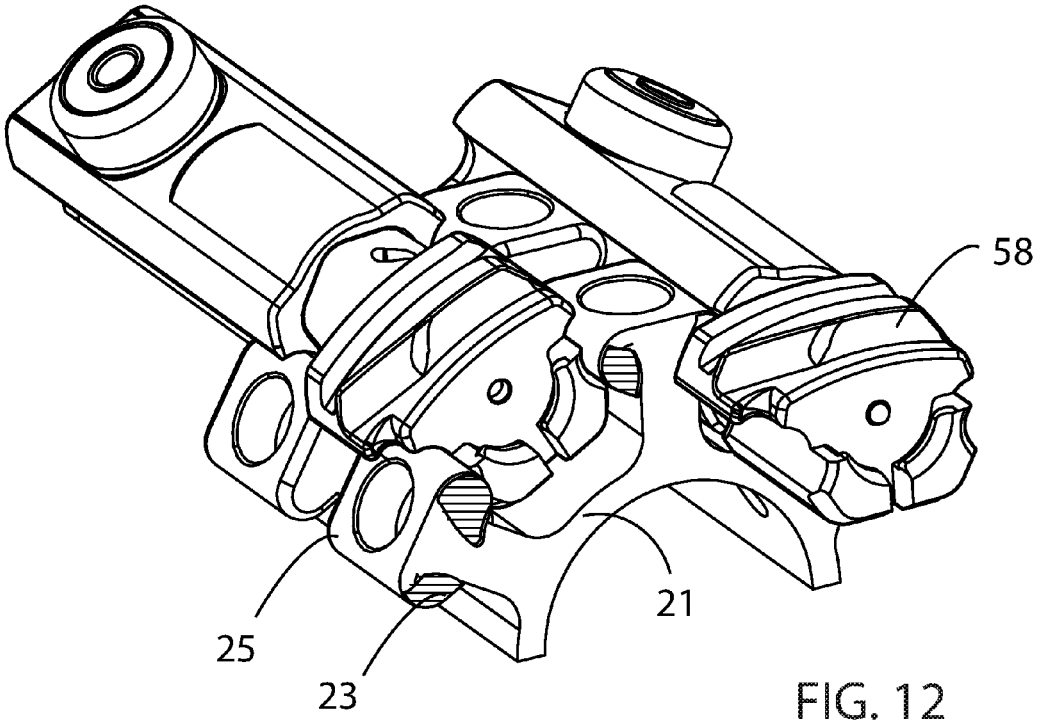
FIG. 12
FIG. 13
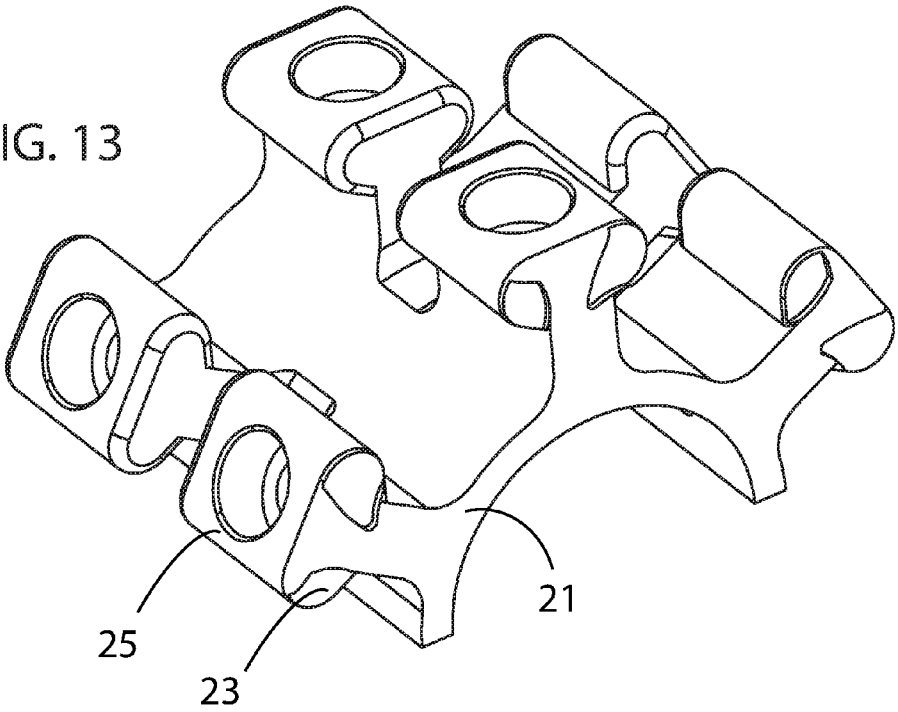

ROTATABLE FIREARM ROTOR

FIELD OF THE INVENTION

The present invention relates to the field of firearms and more particularly relates to a rotor for a multiple barreled rotary firearm.

BACKGROUND OF THE INVENTION

The modern "mini-gun," or M-134, can trace its origins to the original Gatling gun of the mid-nineteenth century. It is a machine gun which fires projectiles in an automatic fashion. In the process of firing these projectiles, the gun utilizes a plurality of barrels (usually six) which consecutively rotate in a circular circuit into a single position which allows for the firing of a projectile. Each barrel, then, is only used to fire one-sixth of the projectiles, spending the remaining time cooling in an air current caused by the rotation of the barrels. Over time, many improvements have been made to the original Gatling gun, resulting in the modern M-134. However, each variant of the M-134 has always featured the rotatable barrels which are the signature characteristic of this family of firearms.

Most modern firearms utilize cartridge ammunition. As cartridge is a fairly simple structure, with a projectile, or bullet, nested over an explosive charge of propellant. The charge and projectile are held together by a casing, or head. This casing presents a rearward primer which, when crushed, ignites and this ignition travels to the charge, igniting it explosively and thereby providing the impetus for launching the projectile. In most modern firearms, particularly with rifles, the primer is impacted by a firing pin. This firing pin is a spring-loaded hammer residing within a firearm bolt and, when released, impacts the primer of properly seated ammunition. The firearm bolt is also used to seat the next successive round of ammunition and, frequently, aids in the ejection of spent cartridges. Usually in an M-134 or Gatling variant, each barrel will have its own bolt. The bolt usually has a body and a head which is movable (rotatable) with respect to the body.

The bolts and barrels are mounted upon a rotor. The rotor is driven by a drive gear connected to the motor of the firearm and, often, serves as a connection to translate rotational motion to a delinker gear so that the firearm delinker may be run from the same motor. It is important that the drive gear and the delinker gear maintain correct timing with respect to each other for proper firearm function. The rotor also provides the structure which keeps each barrel and bolt pair in-line while rotating and allows the longitudinal displacement of each bolt as it travels with the rotor. This structure also features a lock structure for each bolt which secures the bolt at its forward-most (firing) position as each bolt head twists to release its contained firing pin (a process explained in co-pending application Ser. No. 15/000,272, which is incorporated herein by reference in its entirety). Over time, the lock structure wears to the point it requires replacement for the proper functioning of the firearm. Likewise, the gears also wear. When these events occur, the parts must be replaced and, possibly, the entire rotor may have to be replaced.

The present invention represents a departure from the prior art in that the rotor of the present invention allows a replaceable and reversible lock structure, for extended useful life of the lock parts. It also features replaceable gears keyed into the structure of the rotor. This mitigates the need to replace the rotor when gears are worn. Both of these features extend the useful life of the rotor itself and reduce the cost of maintenance of the firearm. A rotor of the present invention may be further adapted to be backwards compatible with existing rotating firearms and be readily usable in future designs.

SUMMARY OF THE INVENTION

In view of the foregoing disadvantages inherent in the known types of rotors, this invention provides a firearm rotor with replaceable components designed to extend the useful life of the rotor. As such, the present invention's general purpose is to provide a new and improved firearm rotor that is backwards compatible with existing M-134 systems and yet even more sturdy and reliable than the prior art rotor systems.

To accomplish these objectives, the firearm rotor may comprise a rotor shaft with a number of bolt tracks and associated lock structures. The lock structures may then be removable from the rotor shaft, but also reversible such that the life of each lock structure is doubled. Drive and delinker gears may also be removable and keyed to the structure of the rotor shaft. In this manner, the gears will be easily replaceable, especially if failure occurs in the field. Also, due to their keyed nature, the drive and delinker gears will maintain a correct timing relationship with each other, allowing for proper firearm function.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 12 is a perspective view of a track lock, with bolts, after significant wear.

FIG. 13 is a perspective view of a worn track lock, without bolts.

DETAILED DESCRIPTION OF THE PREFERRED EMBODIMENT

With reference now to the drawings, the preferred embodiment of the firearm bolt is herein described. It should be noted that the articles "a", "an", and "the", as used in this specification, include plural referents unless the content clearly dictates otherwise.

Figure 1:
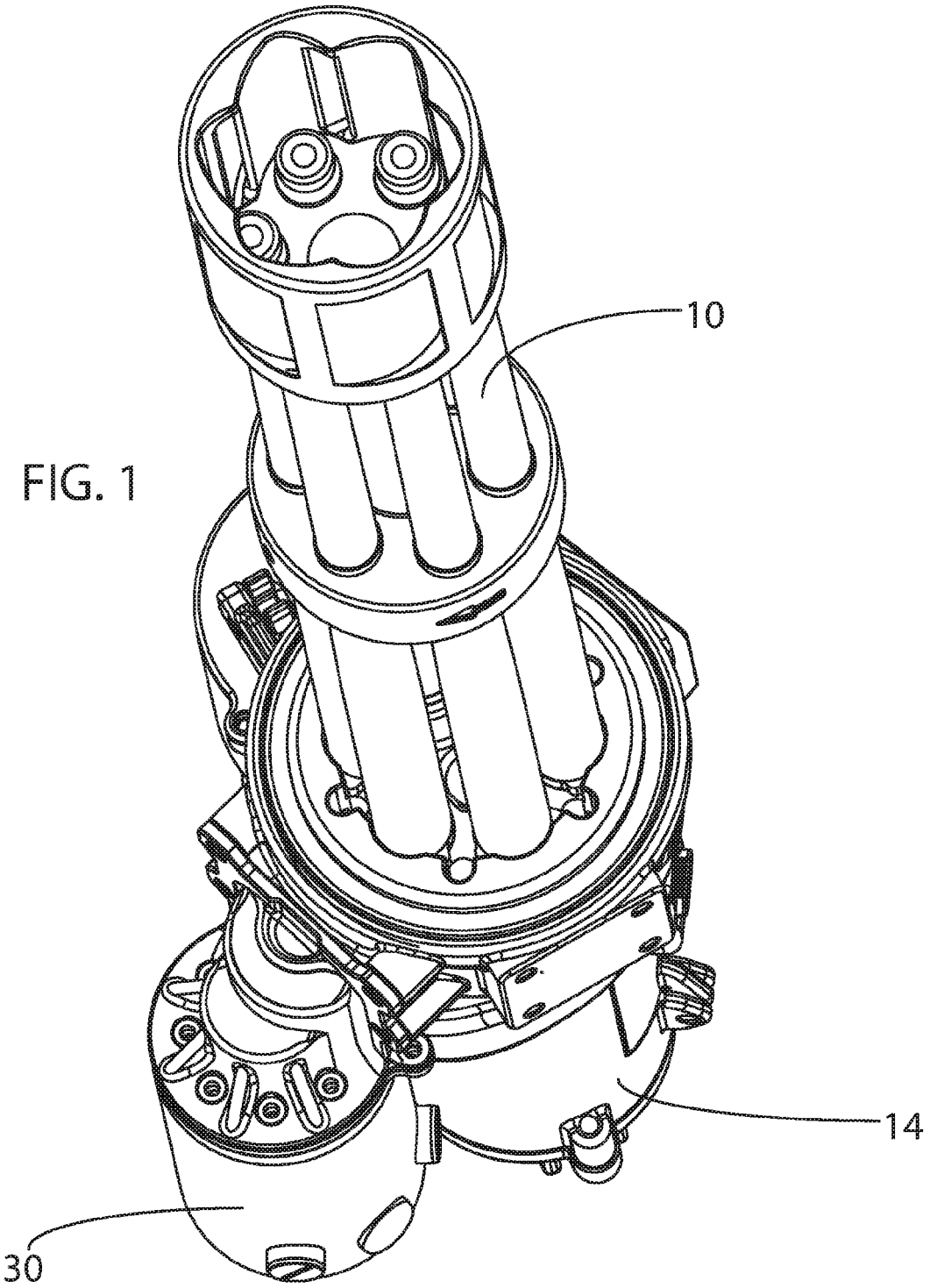
FIG. 1 is a front perspective view of a rotary firearm.
Figure 2:
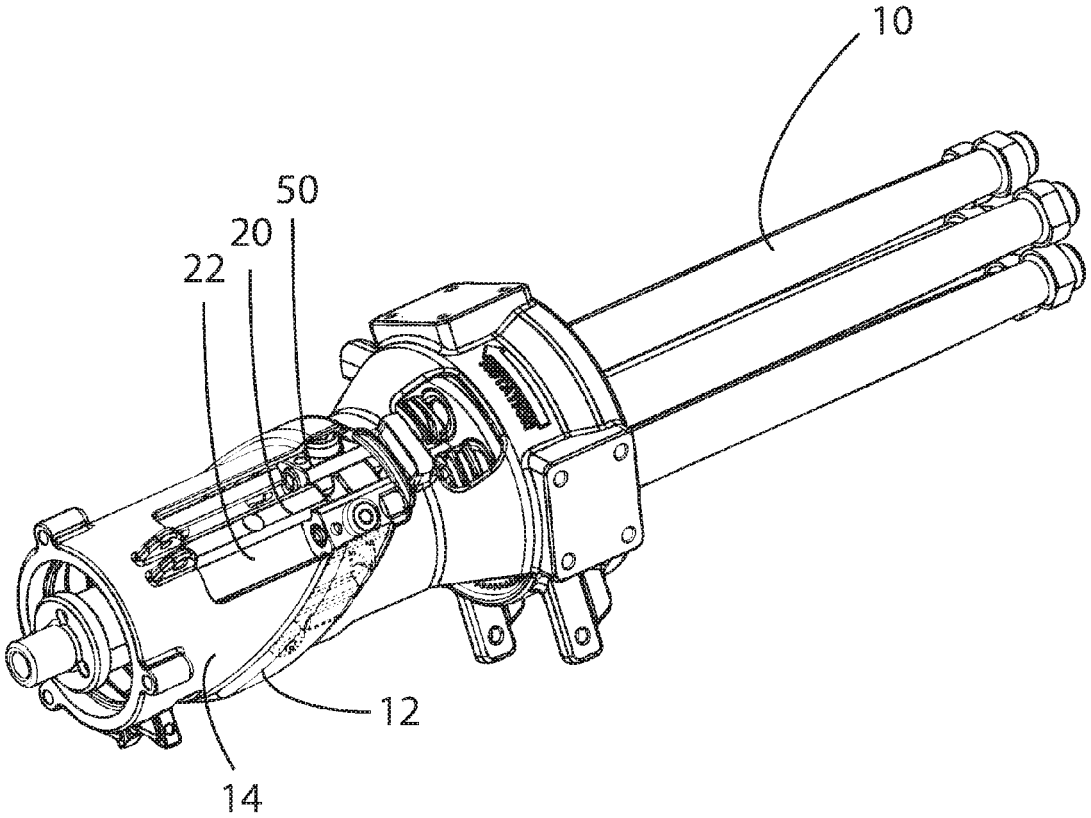
FIG. 2 is a partial sectional view of the rotary firearm of FIG. 1.

With reference to FIGS. 1 and 2, a representational M134 is depicted. As can be seen, this particular firearm embodiment features six barrels 10 mounted on a rotor 20 driven in turn by a motor 30. Belt-linked ammunition is fed into the weapon by first entering the delinker/feeding system, which strips individual rounds of ammunition from connecting links and advances individual rounds of ammunition onto one of six rotating slots 22 in the rotor, each corresponding to one barrel 10 and each having one bolt 50. Ammunition is advanced along a cam track 12 with the bolt 50 until it is chambered in a barrel 10 and ignited. After which the bolt 50 retracts, releasing the spent ammunition casing for ejection.

Figure 3:
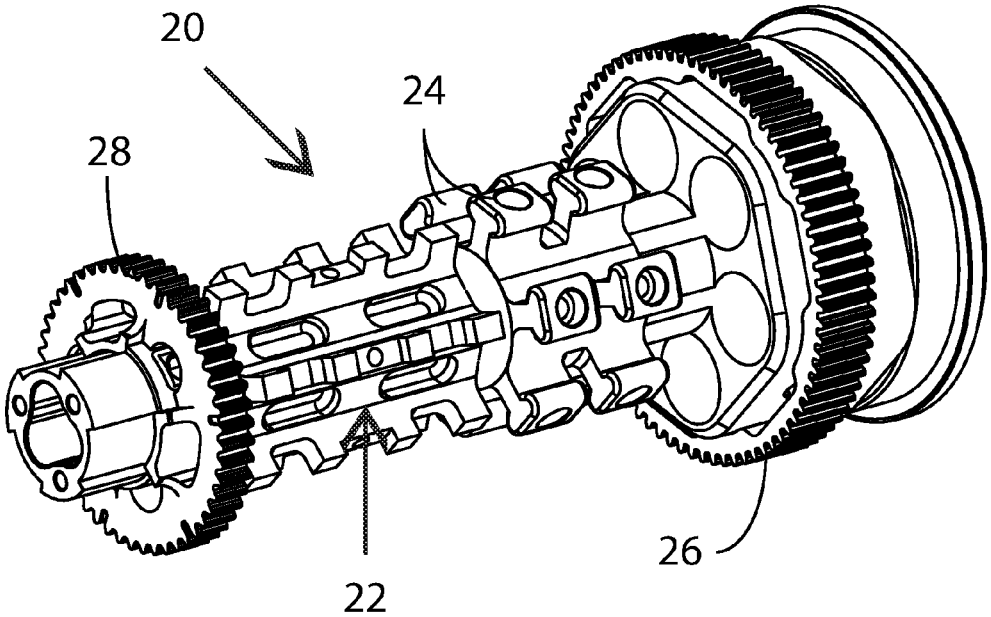
FIG. 3 is a perspective view of a rotor utilized in the rotary firearm of FIG. 1.
Figure 4:
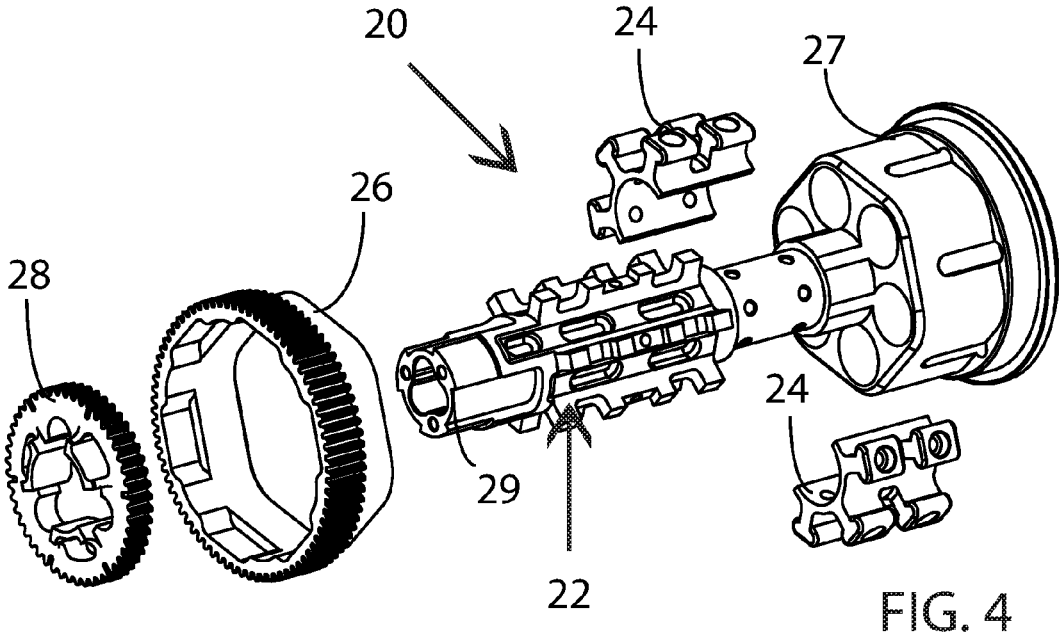
FIG. 4 is an exploded view of the rotor of FIG. 3.
Figure 5:
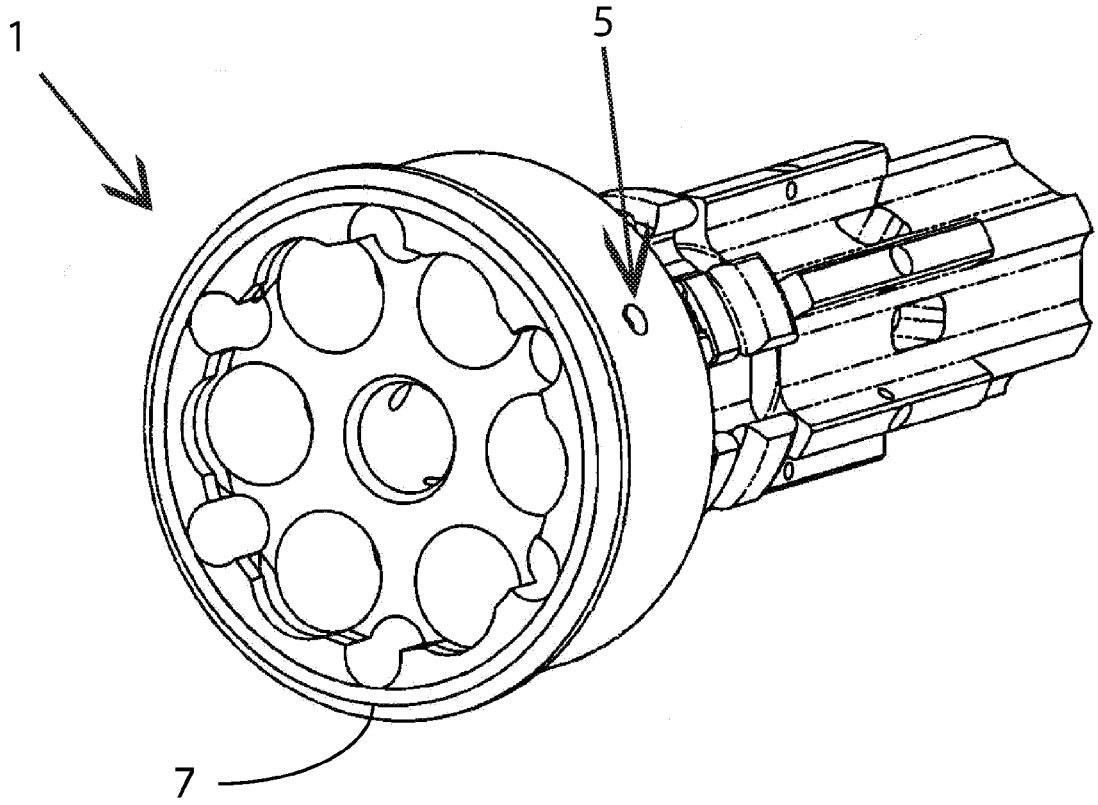
FIG. 5 Prior Art
FIG. 5 is a prior art rotor.

A rotor may serve as a connection of the motor to the delinker. As seen in FIGS. 3 and 4, rotor 20 has a removable drive gear 26 and a removable delinker gear 28. The rotor 20 then connects the motor to the delinker and better allows the entire system to stay in time. The gears are removable as they may wear or break over time. Prior art rotors 1 (FIG. 5) also use removable gears, but such gears are secured by a lock pin in a port 5 along the head of the rotor 7. Thus, when rotating, the force of the motor is positioned upon a lock pin which measures less than a quarter inch in diameter. Should this pin bend or break, the entire force of the motor (about 3 hp in most modern M-134 systems) is uncontrollably released, causing catastrophic failure and further part and system damage or, worse yet, injury. Gears according to the present invention are geometrically keyed onto the rotor head 27 and tail 29. This allows them to be supported and torque to be distributed more efficiently on a number of components, rather than a single pin. In so doing, if a single support load fails, others provide redundancy to the system to allow it to continue functioning until it may be stopped and repaired. The keyed nature of the interfaces also requires the drive 26 and delinker 28 gears to be positioned on the rotor 20 in a manner that preserves their inherent timing. In the illustrated embodiment, a hexagonal structure is imparted to the motor gear 26 and rotor head 27 while three bosses project from the tail 29 to interface with the delinker gear 28. These structures are more than enough to provide adequate support to the gears in question, though other designs are possible, such as the tail shown in FIG. 14. No limitation to the size and shape of the keyed structure should be inferred from the illustrated embodiments. Gears may be held in place by any means known in the art, including by lock pins as the keyed interaction of the gears to their supports distributes torque about the whole of the gear.

Figure 6:
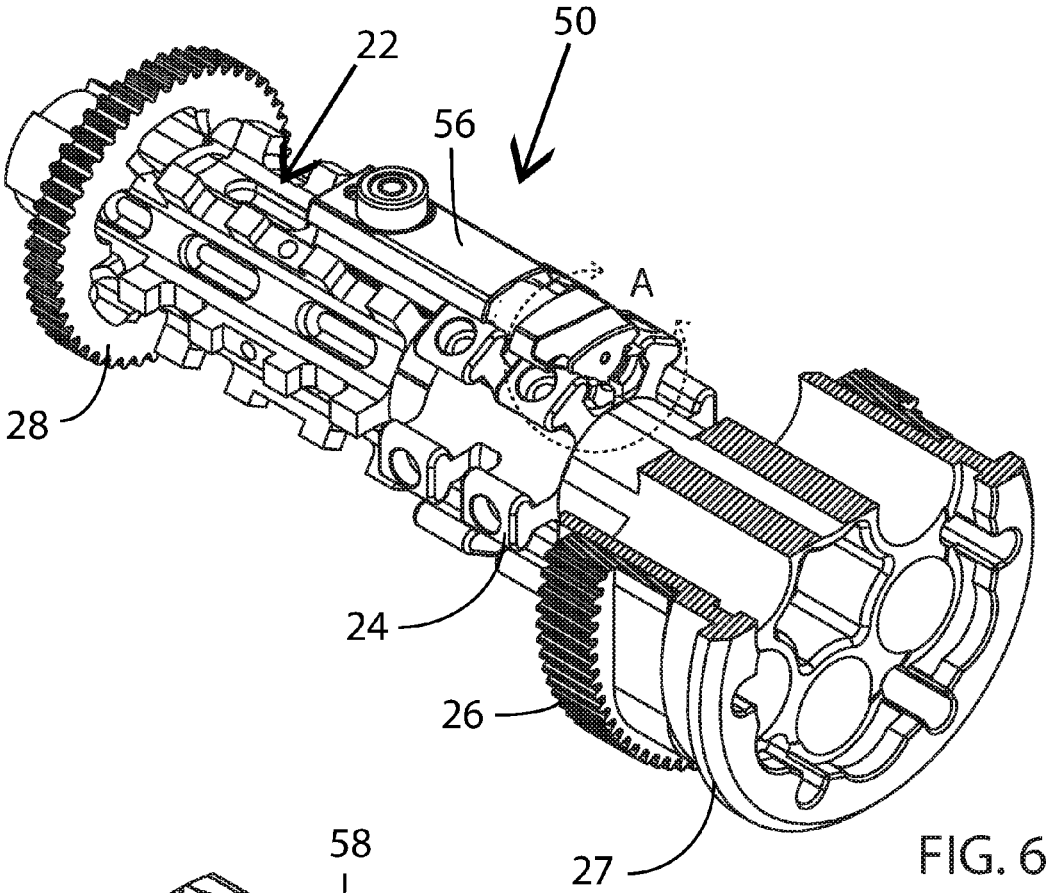
FIG. 6 is a partial section of a rotor of FIG. 3 and bolt, about to fire.
Figure 7:
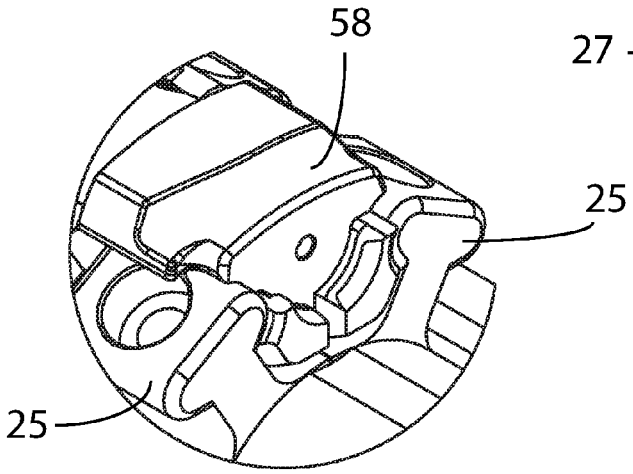
FIG. 7 is a close up view of the rotor and bolt, taken in circle A of FIG. 6.
Figure 8:
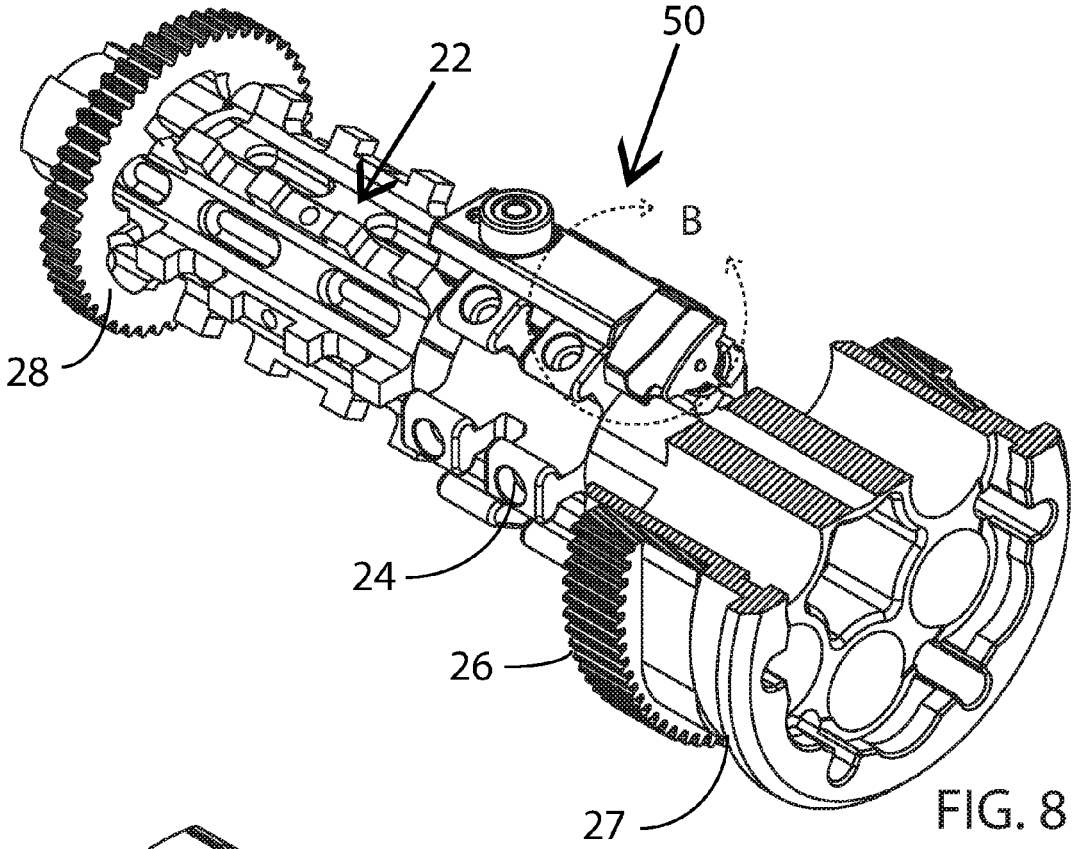
FIG. 8 is a partial section of a rotor of FIG. 3 and bolt, firing.
Figure 9:
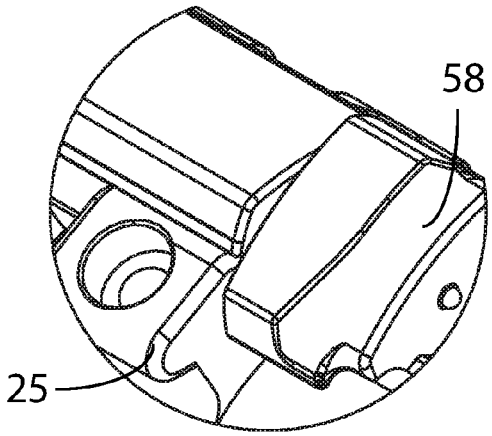
FIG. 9 is a close up view of the rotor and bolt, taken in circle B of FIG. 8.

Advancement and retraction of the bolt 50 is accomplished by the interaction of a cam roller 52, positioned on the top surface of the bolt, and the helical cam track 12 fashioned in the receiver 14 (FIG. 2). As the rotor 20 rotates in a circuit, the cam roller 52 follows the cam track 12 and forces the bolt 50 forward or backwards according to where in the circuit the bolt and rotor are positioned. The forward most position (FIGS. 6 and 7) for the bolt 50 is located when the bolt is at the top of the rotor 20 while the rearward most position has the bolt 50 at the bottom of the rotor 20. At the top of the rotor, the bolt 50 is forced even further forwards (FIGS. 8 and 9), compressing the head 58 against the body 56 of the bolt. Structure in the bolt then forces the head 58 to twist in relation to the bolt body 56. As it twists, the bolt head interfaces with the bosses 25 of track locks 24 to secure the forward position of the bolt 50 during firing. As the bolt 50 retracts, it first draws back the bolt body 56 which untwists the head 58 and releases it from the track lock 24.

Figure 10:
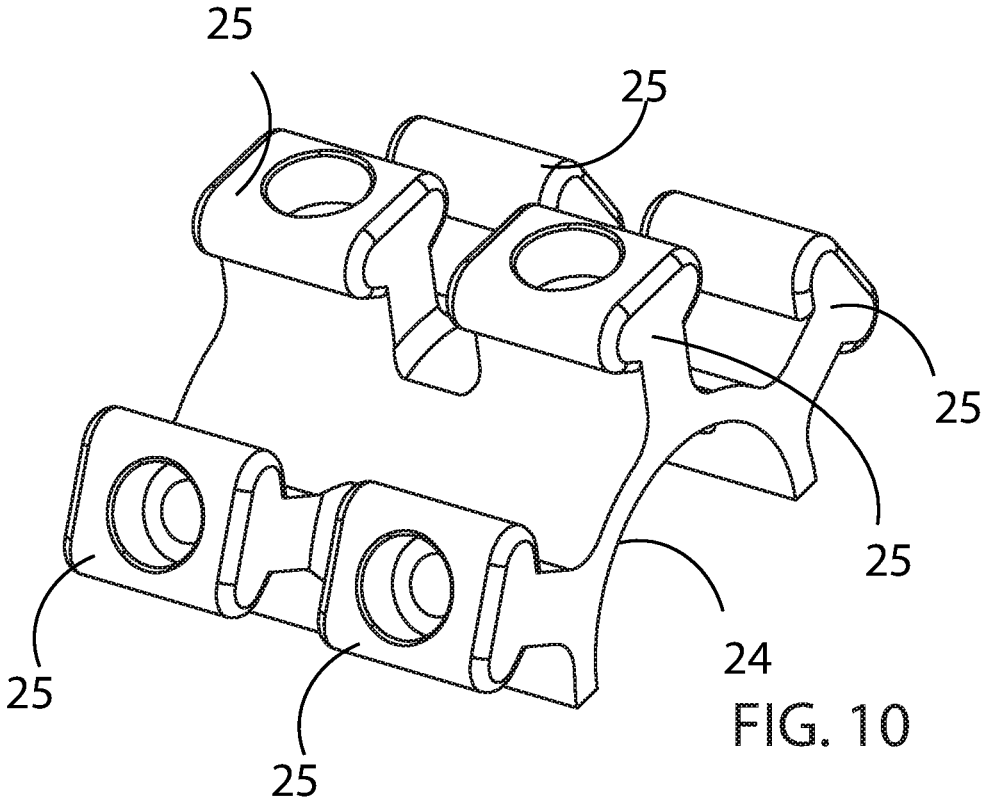
FIG. 10 is a perspective view of a track lock used with the rotor of FIG. 3.
Figure 11:
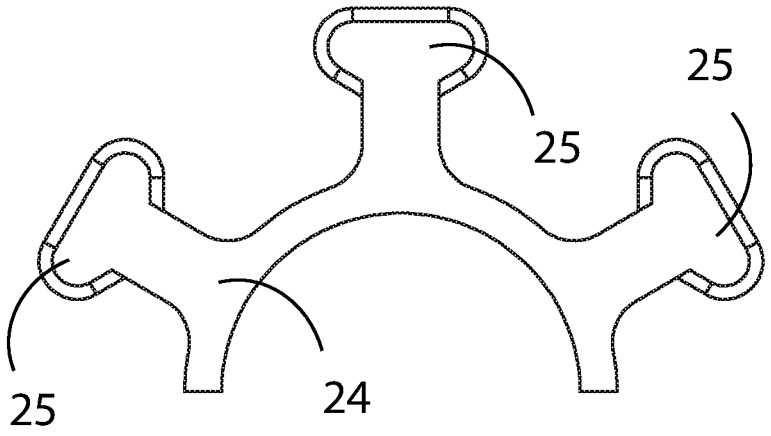
FIG. 11 is an end elevation of the track lock of FIG. 10.
Figure 14:
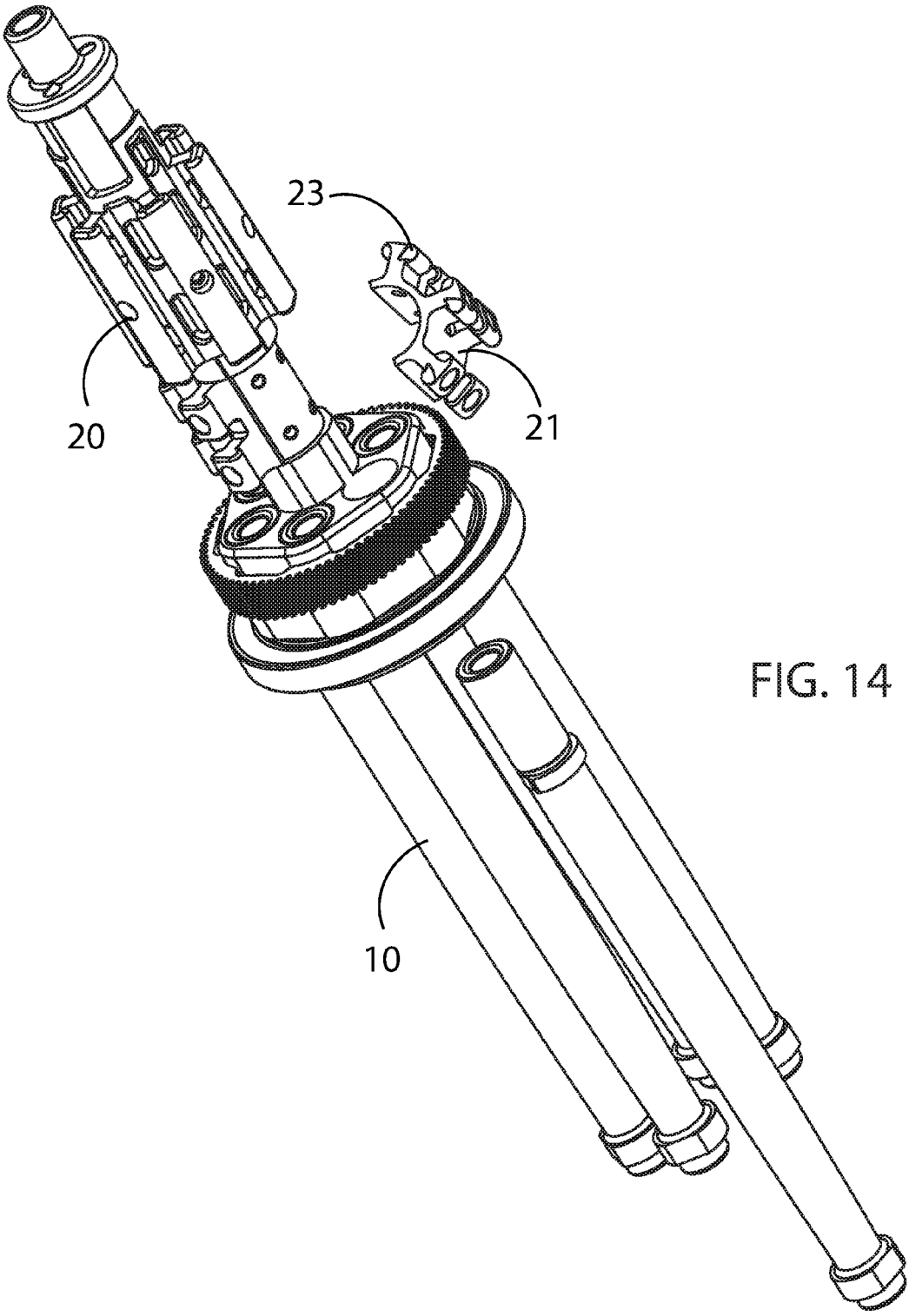
FIG. 14 is a perspective view of a rotor with a worn track lock in the process of being reversed.

The locks 24 of the present invention feature a plurality of bosses 25 (FIGS. 10 and 11) which are mirrored from front-to-back about the lock 24. The illustrated track locks 24 each have six identical bosses 25, so that between two paired track locks 24 six tracks will be formed (two internally for each, two between the edges of where the track locks 24 meet). This is, of course, an exemplary arrangement and any suitable arrangement will be based, in part, on the number of barrels utilized by the firearm. It is suitable, however, to use multiple pieces around the rotor for ease of manufacture and removal from and installation on the rotor 20. Due to the structure and positioning of the bosses 25, the disclosed track lock 24 is reversible and may be installed on the rotor in any direction. This is important as repeated use of the firearm does cause wear on the bosses 25 of track locks 24. An example of the pattern of wear is easily identifiable as the distressed areas 23 shown on worn track lock 21 in FIGS. 12-14. This wear 23 does eventually affect the tolerances of the bolt as the firearm is fires and, when it does, a worn track lock 21 needs replaced. So, when one side is worn and needs replaced, the worn track lock 21 is removed and flipped around, as shown in FIG. 14, and re-installed. The wear 23 on an inner side of bosses 25 is irrelevant to the function of the worn track lock 21 at the middle stages of the bolt's progression, so the ability to reverse the track locks 24 doubles their life and reduces the time down for repair. Track locks 24 may be simply bolted onto the rotor 20, or may be fastened in any manner known or later discovered or engineered for easy removal and secure installation.

Although the present invention has been described with reference to preferred embodiments, numerous modifications and variations can be made and still the result will come within the scope of the invention. The rotor of the present invention may also be readily adapted to perform in currently available M-134 models. No limitation with respect to the specific embodiments disclosed herein is intended or should be inferred.

What is claimed is:

1. A rotor for a rotating firearm comprising;

a rotor shaft; and a plurality of statically mounted reversible track locks with functionally identical sets of bosses located at both a forward and an aft position of each track lock, the reversible track locks being mounted upon the rotor shaft in a manner that they are static in relation to said rotor shaft;

wherein when a set of bosses on one side of one of the plurality of reversible track locks are worn from interaction with at least one firearm bolt, said track lock may be removed and repositioned on the rotor shaft such that another set of bosses may interact with the at least one firearm bolt.

2. The rotor for a firearm of claim 1, further comprising a drive gear that is geometrically keyed to the rotor to divide torque loads across the circumference of the gear.

3. The rotor for a firearm of claim 2, further comprising a delinker gear that is geometrically keyed to the rotor to divide torque loads across the circumference of the gear.

4. The rotor for a firearm of claim 1, further comprising a delinker gear that is geometrically keyed to the rotor to divide torque loads across the circumference of the gear.

* * * * *